US008720583B2

(12) United States Patent
Rodger

(10) Patent No.: US 8,720,583 B2
(45) Date of Patent: May 13, 2014

(54) TELESCOPIC JOINT MINI CONTROL PANEL

(75) Inventor: Bradley Ray Rodger, Humble, TX (US)

(73) Assignee: Transocean Sedco Forex Ventures Limited, George Town Grand Cayman (KY)

( * ) Notice: Subject to any disclaimer, the term of this patent is extended or adjusted under 35 U.S.C. 154(b) by 1113 days.

(21) Appl. No.: 12/341,931

(22) Filed: Dec. 22, 2008

(65) Prior Publication Data

US 2009/0159291 A1 Jun. 25, 2009

Related U.S. Application Data

(60) Provisional application No. 61/015,494, filed on Dec. 20, 2007.

(51) Int. Cl.

| | |
|---|---|
| ***E21B 33/038*** | (2006.01) |
| ***E21B 17/01*** | (2006.01) |
| ***E21B 33/035*** | (2006.01) |
| ***E21B 17/02*** | (2006.01) |
| ***E21B 43/013*** | (2006.01) |
| ***E21B 43/01*** | (2006.01) |

(52) U.S. Cl.

USPC ..... 166/355; 166/367; 166/345; 166/350; 166/179

(58) Field of Classification Search

USPC ..... 166/355, 335, 367, 179, 126, 129, 142, 166/145, 146, 147, 148, 149; 285/96; 405/224.1–224.4

See application file for complete search history.

(56) References Cited

U.S. PATENT DOCUMENTS

| | | | | |
|---|---|---|---|---|
| 4,140,426 | A * | 2/1979 | Knox | 405/225 |
| 4,367,981 | A | 1/1983 | Shapiro | |
| 4,854,384 | A | 8/1989 | Campbell | |
| 5,727,630 | A * | 3/1998 | Brammer | 166/355 |
| 5,925,879 | A | 7/1999 | Hay | |
| 6,148,664 | A | 11/2000 | Baird | |
| 6,244,359 | B1 * | 6/2001 | Bridges et al. | 175/5 |
| 6,547,011 | B2 * | 4/2003 | Kilgore | 166/387 |
| 6,761,222 | B2 * | 7/2004 | Wilson | 166/387 |

OTHER PUBLICATIONS

International Search Report issued Feb. 18, 2009, during the prosecution of International Application No. PCT/US08/88057.

Written Opinion issued Feb. 18, 2009, during the prosecution of International Application No. PCT/US08/88057.

International Preliminary Report on Patentability Search Report issued Feb. 9, 2010 during the prosecution of International Application No. PCT/EP2008/006428.

International Preliminary Report on Patentability Search Report issued Jun. 22, 2010 during the prosecution of International Application No. PCT/US2008/088057.

* cited by examiner

*Primary Examiner* — James Sayre

(74) *Attorney, Agent, or Firm* — Fulbright & Jaworski LLP

(57) ABSTRACT

A method and apparatus for determining and reacting to an upper packer failure in a riser slip joint. An upper packer failure is determined by comparing pressures at two points in the upper packer pressure circuit using a differential pressure valve. In the event of a failure of the upper packer, a secondary pressure source is used to energize a lower packer in the riser slip joint.

26 Claims, 6 Drawing Sheets

TELESCOPIC JOINT MINI CONTROL PANEL

CROSS-REFERENCE TO RELATED APPLICATIONS

This application claims benefit of U.S. Provisional (35 U.S.C. §119(e)) Application No. 61/015,494, filed on Dec. 20, 2007, which is incorporated by reference herein in its entirety.

TECHNICAL FIELD

The invention relates in general to offshore drilling equipment, and in particular, the present invention provides an apparatus and a method for eliminating and/or reducing the accidental discharge of drilling fluids by automatically energizing the lower packer of the telescopic joint when the upper/primary packer loses pressure. The present invention provides apparatuses and methods for energizing the lower packer when the upper packer control hose fails, the upper packer leaks and/or rig air pressure is lost.

BRIEF SUMMARY OF THE INVENTION

The present invention provides a pressure circuit for recognizing an upper packer failure comprising an upper packer; a first pressure source; a first pressure circuit connected to the first pressure source and the upper packer; a differential pressure valve that receives pressure from two points along the first pressure circuit, wherein the first point is closer to the first pressure source than the second point, and wherein the differential pressure valve opens when the pressure from the second point is an operational amount below the pressure from the first point; a second pressure source; and a second pressure circuit connected to the second pressure source and the differential pressure valve, wherein a portion of the second pressure circuit is isolated from the second pressure source downstream of the differential pressure valve when the differential pressure valve is closed. In one application, the operational limit is 0.5 psi lower than the pressure at the first point. The inventive circuit may includes a lower packer, wherein pressure from the second pressure source causes the lower packer to be energized when the differential pressure valve opens. The first pressure source may be the slip joint air pressure and said second pressure source may be the rig air pressure. The inventive circuit may include a hydraulic pressure source operably engaged to a lower packer, wherein the hydraulic pressure source energizes the lower packer responsive to the second pressure source. They hydraulic pressure source may be from the diverter panel.

The disclosed pressure circuit may include a third pressure source, a third pressure circuit connected to the third pressure source, and a normally open shuttle valve connected to the third pressure circuit and the second pressure circuit, wherein the normally open shuttle valve isolates the third pressure from portions of the third pressure circuit downstream of the normally open shuttle valve while the second pressure source is at or above an operational rig pressure. The third pressure source may be an air receiver cylinder that may be charged by the second pressure source.

Another aspect of the present invention is a riser slip joint circuit comprising, an upper packer; a lower packer; a first conduit containing a first pressure; a second conduit containing a second pressure, wherein the second conduit is connected to the first conduit and the upper packer; a third conduit containing a third pressure; and a differential pressure valve connected to the first, second, and third conduits, wherein the differential pressure valve allows the third pressure to energize the lower packer when the second pressure is operationally lower than the first pressure. The riser slip joint circuit may also include a flow control valve positioned between the first conduit and the second conduit. The second conduit includes a readback line.

The riser slip joint circuit may also include a fourth conduit containing a fourth pressure and a normally open valve connected to the third and fourth conduit, wherein the normally open valve allows the fourth pressure to energize the lower packer when the third pressure drops below an operational limit. The riser slip joint circuit may also include a receiver cylinder connected to the fourth conduit and wherein the fourth pressure is provided by the receiver cylinder. The riser slip joint may also include a one-way valve between the third conduit and the forth conduit such that the fourth pressure is equal to or greater than the third pressure.

The riser slip joint circuit may also include a hydraulic pressure source connected to the lower packer, wherein the third pressure opens the hydraulic source when the second pressure is operationally lower than the first pressure. The hydraulic source may be a diverter control panel. The riser slip joint may further include a fourth conduit containing a fourth pressure and a normally open valve connected to the third and fourth conduit, wherein the normally open valve allows the fourth pressure provides a signal to the hydraulic source when the third pressure drops below an operational limit. The first and second conduits of the riser slip joint may be connected to the same pressure source, with the second conduit being further from the pressure source than the first conduit.

In one aspect of the riser slip joint circuit, the first conduit, second conduit, third conduit, and differential pressure valve are located within a mini-control panel.

Another aspect of the invention is a method of controlling a riser slip joint comprising the steps of transmitting slip joint pressure along a path between a pressure source and an upper packer; comparing pressure at two points along the path using a differential pressure valve, wherein the distance between the two points is sufficient to cause the pressure at the point closest to the upper packer to be lower than the pressure at the point closest to the pressure source when there is a significant upper packer leak. The method may also include the step of providing a pilot pressure to a hydraulic valve when the pressure at the point closest to the upper packer is an operationally lower than the pressure at the point closest to the pressure source. The method may also include the step of pressurizing the lower packer with hydraulic pressure when a pilot pressure is supplied to the hydraulic valve. The pilot pressure may be provided by the rig air supply. The method may comprise the step of providing a pilot pressure from a pressure reservoir to a hydraulic valve when the pressure provided by the pressure source drops below an operational limit. The method may comprise the step of providing a pilot pressure from a pressure reservoir through a normally open valve to a hydraulic valve when rig pressure is insufficient to maintain the normally open valve in a closed position. The method may comprise the step of restricting air from flowing between the first point and the second point with a flow control valve. The method may comprise flipping a mechanical indicator switch with the pilot pressure when the lower packer has been energized.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other methods for carrying out the same purpose of the present invention. It should be also realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood form the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

It is readily apparent to one skilled in the art that various embodiments and modifications can be made to the invention disclosed in this Application without departing from the scope and spirit of the invention.

Figure 1:
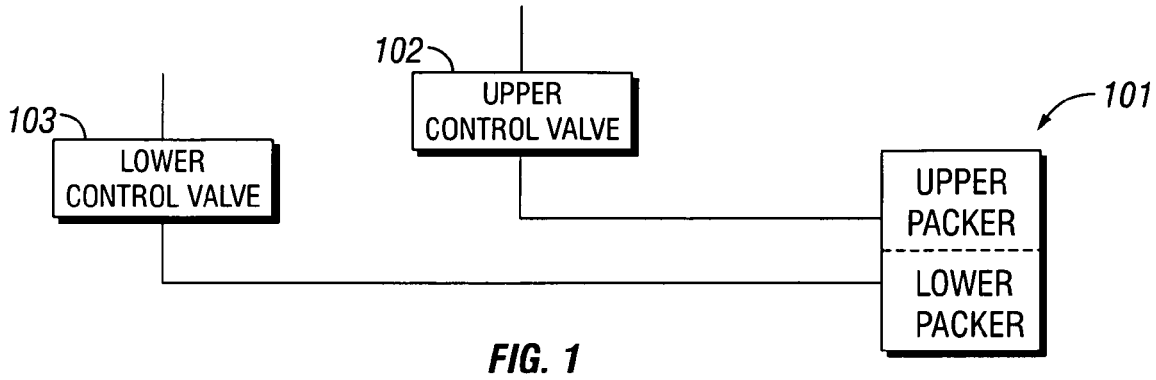
FIG. 1 shows a schematic of a typical dual packer riser slip joint.

The invention relates to a mini-control panel that provides automatic control of a lower packer in case of a pressure loss to an upper packer. FIG. 1 shows a schematic of a typical dual packer telescopic slip joint. In FIG. 1, packer housing 101 contains an upper packer and a lower packer. The upper control valve 102 controls the pressure to the upper packer, and the lower control valve 103 controls the pressure to the lower packer. In a typical configuration, the upper packer is energized with pneumatic pressure and the lower packer is energized with hydraulic pressure. Typically, the upper control valve and the lower control valve are part of the diverter control panel. In the design of FIG. 1, a failure or pressure loss in the upper packer requires an operator to recognize the failure and manually initialize the lower packer. The time it takes to recognize a failure and manually initialize the lower packer often results in excessive loss of drilling fluids. Therefore, there is a need to automatically energize the lower packer in order to prevent the loss of drilling fluids.

The present invention provides an apparatus and a method for eliminating and/or reducing the accidental discharge of drilling fluids by automatically energizing the lower packer when the upper packer system fails. Failure in a typical system occurs when there is a significant leak in the system that allows the upper packer to lose pressure. One skilled in the art readily understands that an upper packer may have small leak that would not be considered a failure. A "significant" leak occurs when the upper packer leaks enough to warrant energizing the lower packer. A "failure" in an upper packer circuit occurs when enough drilling fluid leaks past the upper packer to justify energizing the lower packer. One skilled in the art also understands the inventive pressure circuit can be adjusted to be more or less sensitive to leaks, taking into consideration normal fluctuations in rig air pressure and pressure pulses resulting from slip joint use.

Figure 2:
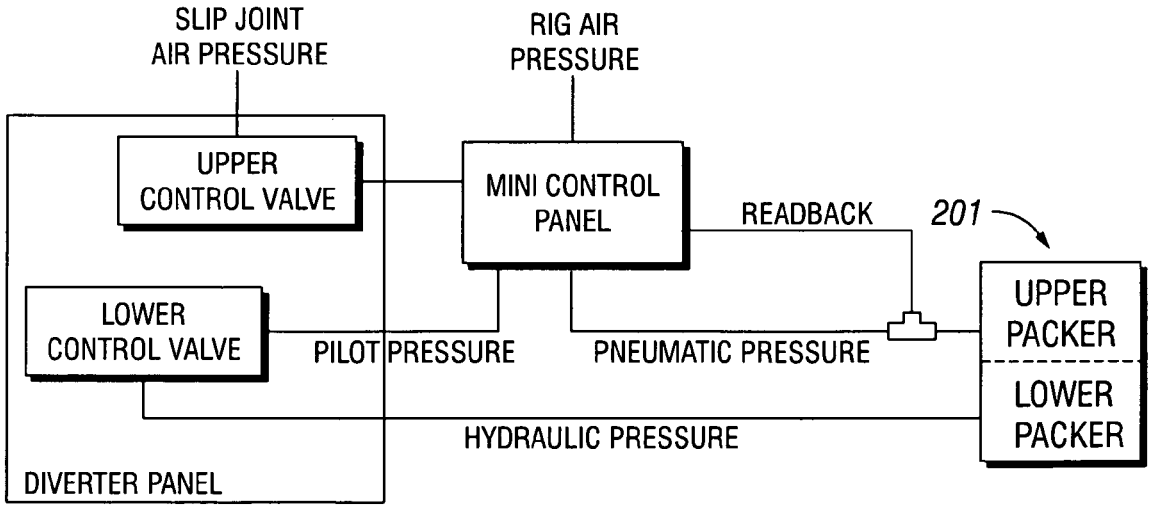
FIG. 2 shows a schematic of the mini-control panel incorporated into a typical dual packer riser slip joint.

FIG. 2 shows a schematic of a dual packer system that is automatically controlled by the mini-control panel. During an upper packer failure, the mini-control panel sends a pilot pressure to the diverter panel to energize the lower packer. Typically, the pilot pressure opens a hydraulic valve that energizes the lower packer with hydraulic fluid.

As will be explained below, the mini-control panel responds to differential pressures in the upper packer circuit. As such, it can be installed on a number of different rigs without having to be tailored to the particular rig. FIG. 2 shows a typical installation in which the mini-control panel is a discreet component of the riser slip joint. It should be understood, however, that the functionality provided by the mini-control circuit can be provided by incorporating the relevant components directly into the diverter control panel, the riser slip joint, combinations thereof, or any other convenient location. In a preferred embodiment, the pneumatic circuitry is included in the disclosed mini-control panel. Combining the relevant circuitry in the mini-control panel makes retrofitting existing rigs easier.

Figure 3:
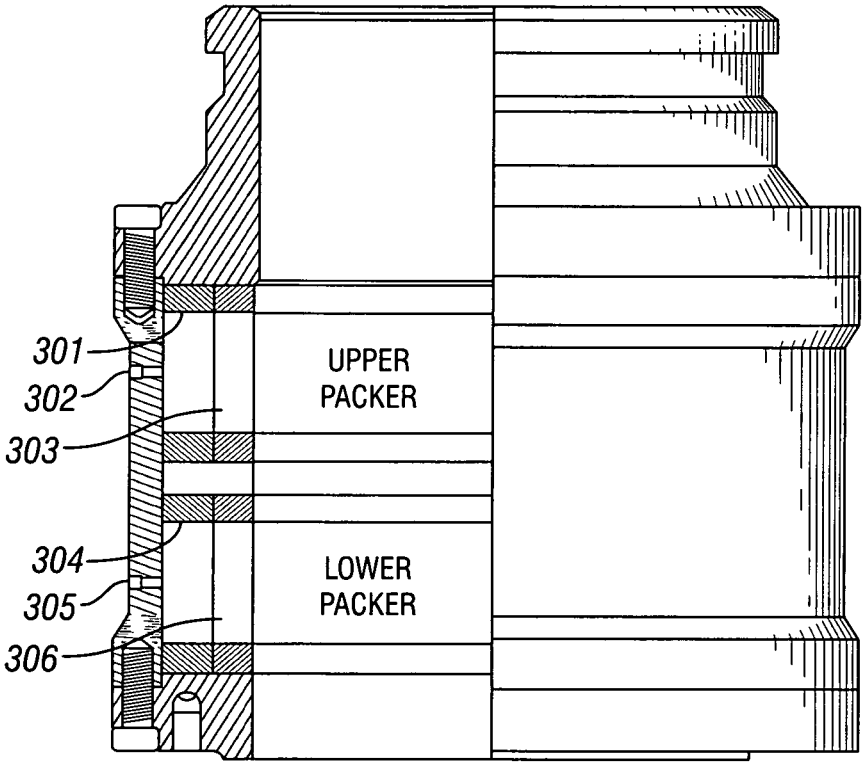
FIG. 3 shows a dual packer slip joint housing.

FIG. 3 shows a typical slip-joint dual packer housing. Other dual packer or multi-packer systems may be used, and such equivalent systems do not depart from the scope and spirit of the invention. The dual packer housing comprises an upper and lower packer. In FIG. 3, the upper packer further comprises an outer packer 301 and an inner packer 303. The lower packer comprises an outer packer 304 and an inner packer 306. In both upper and lower packer, the inner packer presses against the inner barrel of the slip joint. The upper and lower packers are energized through the portals 302 and 305, respectively. Although pneumatic pressure is typically used to energize the upper packer and hydraulic pressure is used to energize the lower packer, one skilled in the art understands that different combinations may be used. As used herein, air and pneumatic pressure is used interchangeably and can represent air or any other suitable gas. When used in the claims, "pressure" may be pneumatic or hydraulic.

Figure 4:
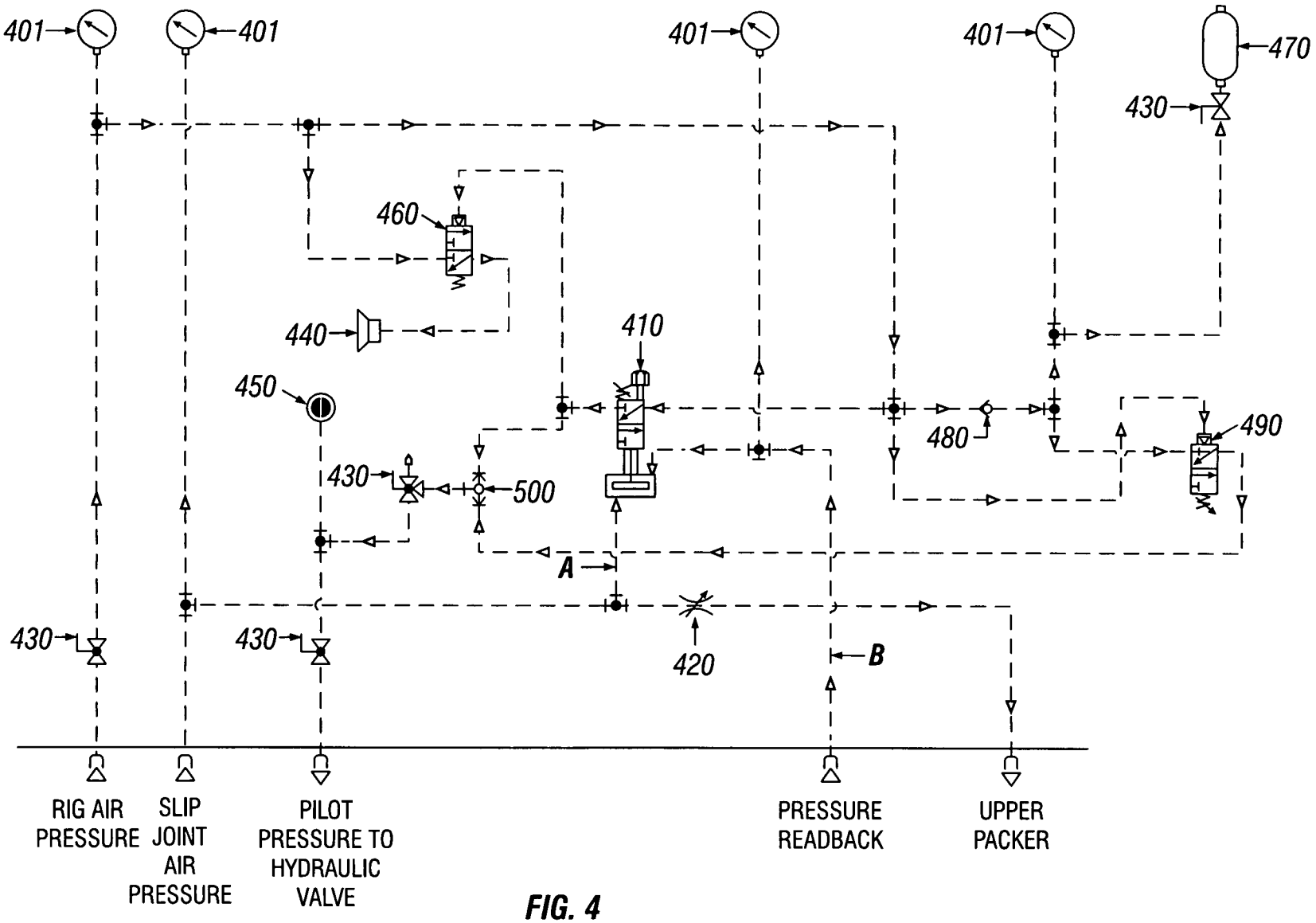
FIG. 4 shows the mini-control panel pressure circuit.

FIG. 4 shows the mini-control panel pneumatic circuitry according to a preferred embodiment. The mini-control panel includes inputs for the slip joint air pressure, rig air pressure, and pressure readback line. The mini-control panel includes outputs for the upper packer pressure line and pilot pressure line. Under normal operating conditions, pressure in the tubing between the slip joint air supply input and upper packer output line and the pressure in the pressure readback line are the same.

In a typical riser slip joint, the lower packer is not energized unless the upper packer fails. Because the lower packer is a back-up, it is often energized using a secondary pressure source. In the embodiment shown, the secondary pressure source is hydraulic pressure from the diverter control panel (shown in FIG. 1).

The mini-control panel shown in FIG. 4 is not plumbed with hydraulic pressure. When the upper packer fails, the mini-control panel provides a pilot pressure to the secondary pressure source. The pilot pressure opens the secondary pressure source and the secondary pressure source energizes the lower packer. One skilled in the art understands that the secondary pressure source can also be plumbed through the mini-control panel. For example, instead of outputting a pilot pressure, the mini-control panel may include a secondary pressure input and output line. In this embodiment, instead of generating a pilot pressure, secondary pressure would be released directly to the lower packer.

The mini-control panel circuit includes differential pressure valve 410. Differential pressure valve 410 is a 3-way, normally closed, adjustable valve. Differential pressure valve 410 receives two pressures from the upper packer pressure circuit (see FIG. 5 for the upper packer pressure circuit). The first pressure is provided by line A. Line A tees into the upper packer pressure circuit relatively close to the slip joint air pressure input. The second pressure is provided by line B. Line B is further away from the slip joint air pressure input and tees into the slip joint air pressure line close to the upper packer (See FIG. 2). Distance is with respect to the distance air would travel if it were flowing through the mini-control panel circuit. Thus, as can be seen from FIG. 4, line B is further away from the slip joint air pressure connection than line A. Stated differently, line B is downstream of line A. When the pressure in line B is operationally lower than the pressure in line A, the pressure from line A opens differential pressure valve 410. How much lower the pressure in line B has to be before it is considered "operationally lower" is based on the what constitutes a failure event. Generally, the difference must be high enough that the pressure in A does not open differential pressure valve 410 during normal pressure fluctuations. Optimally, differential pressure valve 410 will open when the pressure in line B is at least 0.5 to 20 psi lower than the pressure in line A. Because differential pressure valve 410 is normally closed, it remains closed if the pressure in line B is higher than the pressure in line A, or if pressure drops equally in both lines.

In the preferred embodiment, line B is referred to as the pressure readback line. The pressure readback line is split from the upper packer pressure line just before the upper packer (shown in FIG. 2). In an alternative embodiment, line B can be plumbed into the slip joint air pressure line inside the mini-control panel. FIG. 4 also shows optional flow control valve 420. Flow control valve 420 is positioned between line A and line B and is designed to restrict air flow into line B. Flow control valve 420 is optional because the pressure drop caused by frictional losses between the point at which line A is plumbed into the upper packer pressure circuit and line B may be sufficient to indicate an upper packer leak. However, if the distance between line A's input into the differential pressure valve 410 and line B's input into the differential pressure valve 410 is short, flow control valve 420 helps amplify the pressure loss in line B.

The mini-control panel also includes a number of isolation valves 430 and pressure gauges 401. Isolation valves 430 may be used during maintenance and to re-set the system after the lower packer has been energized. Pressures gauges 401 are strategically positioned to register pressures within the mini-control panel. Pressure gauges 401 provide an operator with a convenient way to confirm initial set-up. Pressure gauges 401 also serve as a back-up to rig pressure gauges (not shown).

Figure 5:
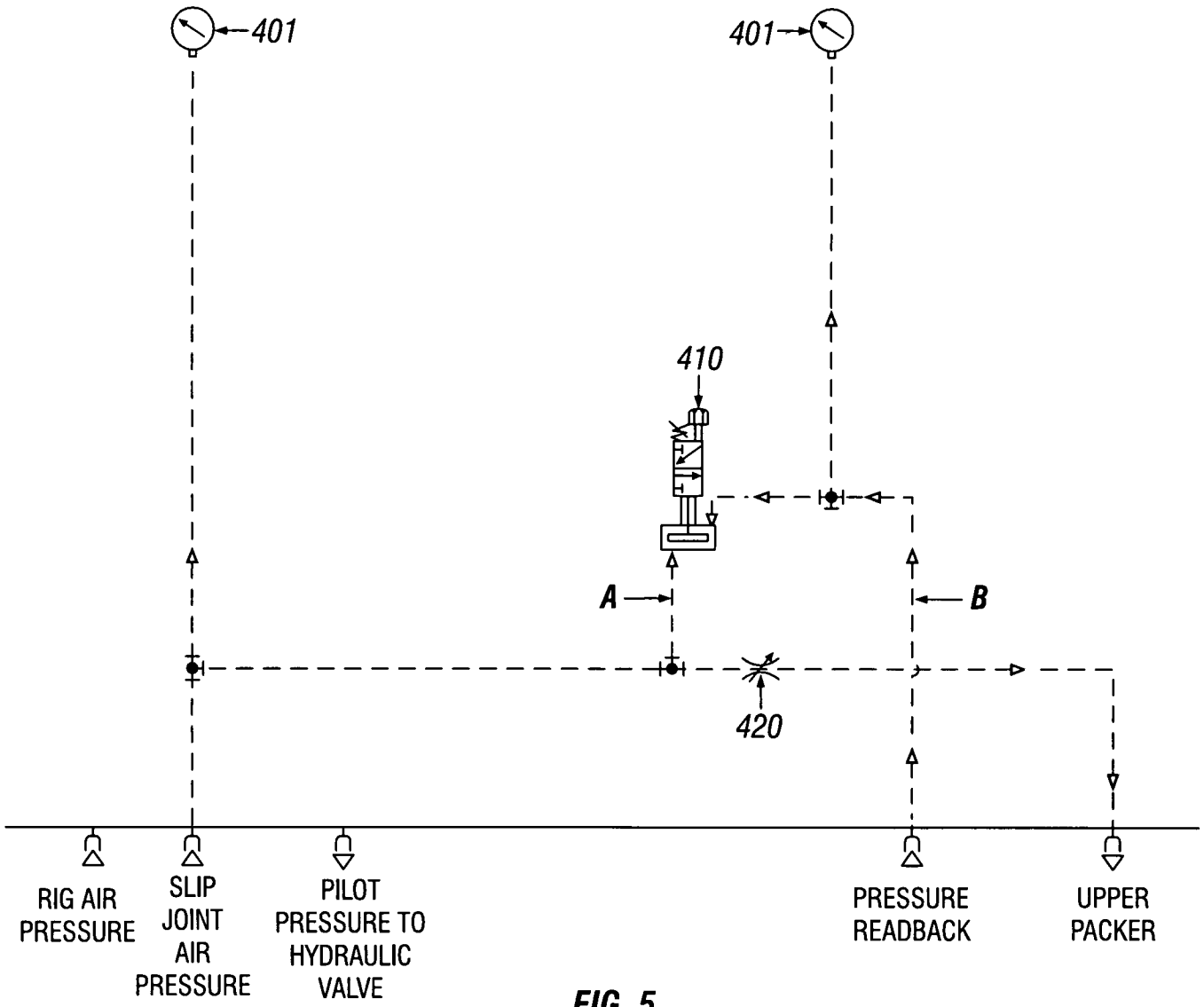
FIG. 5 shows a portion of the mini-control panel pressure circuit to highlight normal operation of the upper packer.
Figure 6:
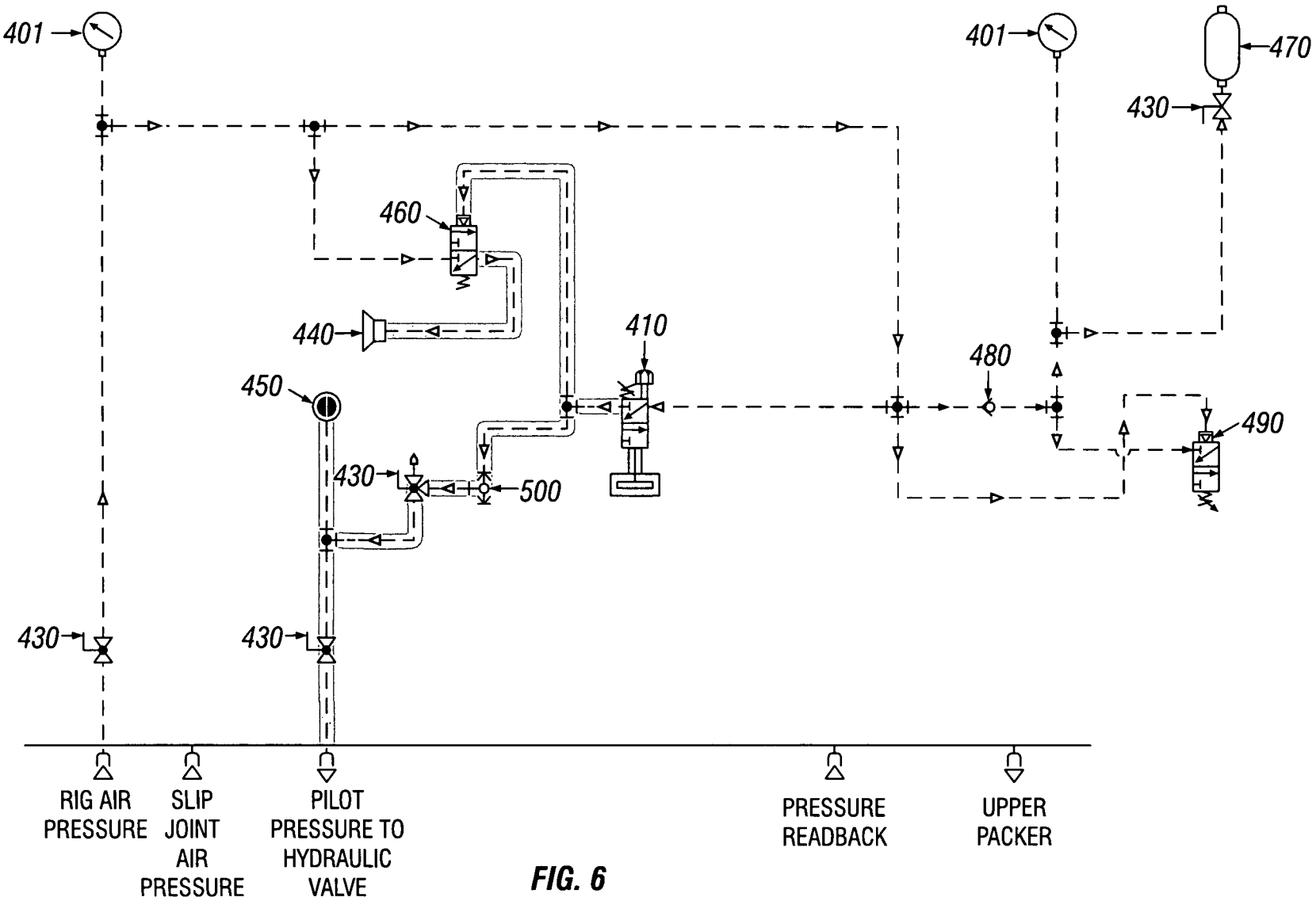
FIG. 6 shows a portion of the mini-control panel pressure circuit to highlight how rig pressure is used to initiate pressurization of the lower packer; and, FIG. 7 shows a portion of the mini-control panel pressure circuit to highlight how reservoir pressure is used to initiate pressurization of the lower packer.
Figure 7:
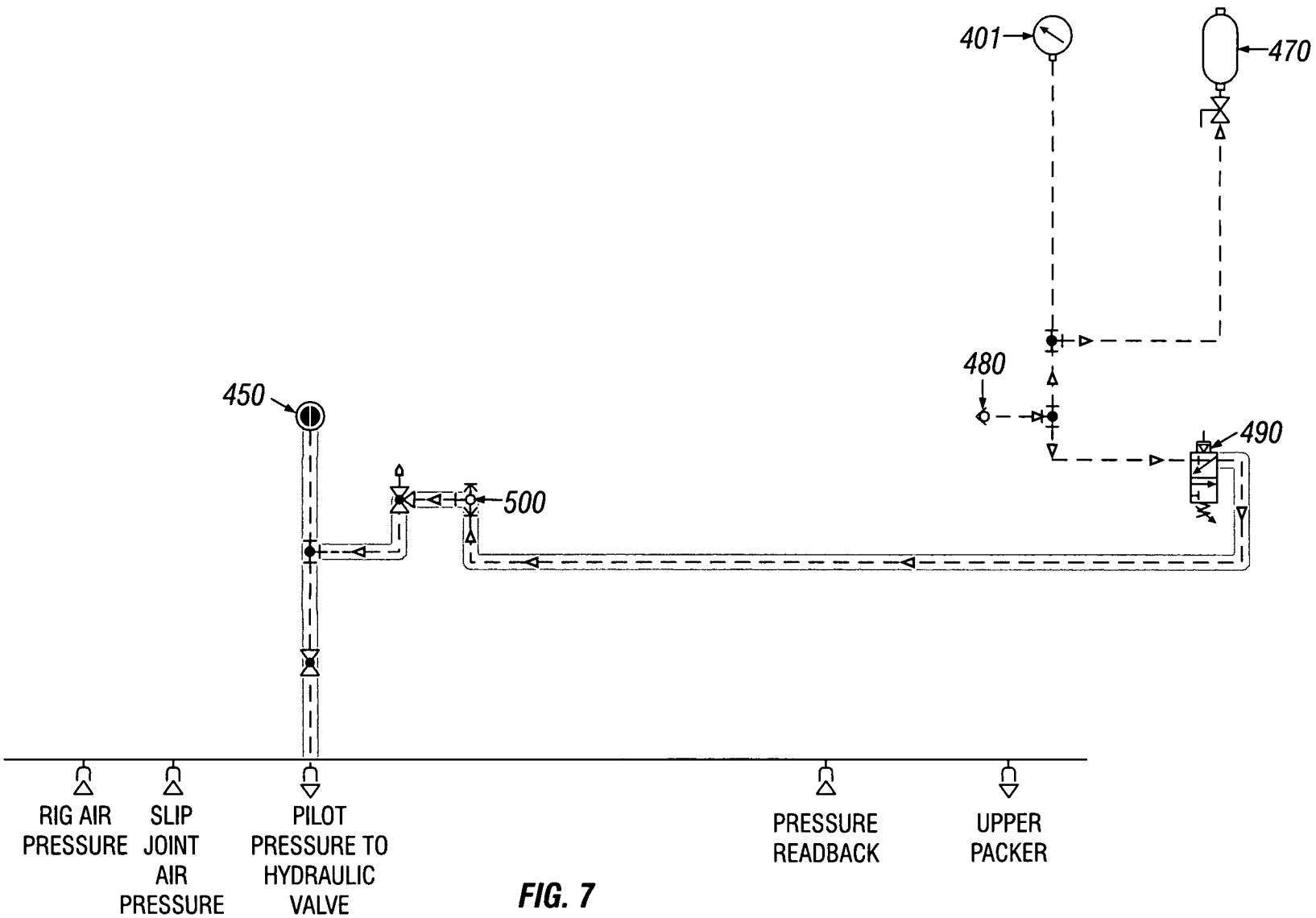

FIGS. 5-7 show portions of the mini-control panel circuit of FIG. 4 to highlight different aspects of the circuit. FIG. 5 highlights portions of the mini-control panel pressure circuit that provide slip joint air pressure to the upper packer. For simplicity, the pressure circuit shown in FIG. 5 will be referred to as the upper packer pressure circuit. The upper packer pressure circuit is pressurized with the slip joint air pressure. The slip joint air pressure is generally less than the rig air pressure. The rig air pressure generally ranges from 110-120 psi. The preferred slip joint air pressure is between 40-90 psi.

When the upper packer is pressurized and functioning normally, pressure throughout the upper packer pressure circuit is the same as the upper packer pressure and air does not flow through the circuit. If there is a leak in the upper packer pressure circuit, air flows toward the leak (low pressure). For small leaks, the air flow is minimal and can often be ignored. For large leaks, the air flow will be significant. As air flows through the circuit, frictional losses result in different air pressures at different points in the circuit. For example, if the upper packer develops a significant leak, the air pressure in the line just prior to the leak will drop, perhaps as low as ambient air pressure. The pressure in the circuit close to the slip joint air pressure connection, however, will remain at or close to the slip joint air pressure. This pressure difference is caused by frictional loses in the tubing between slip joint air pressure connection and the upper packer. In the embodiment shown, a readback pressure line is used. The readback pressure line is plumbed into the upper packer pressure circuit just prior to the upper packer. In this configuration, the tubing between line A and line B is long enough that the pressure in line B will be lower than the pressure in line A due to frictional losses. In an alternative embodiment, flow control valve 420 can be used to further amplify the pressure differences.

FIG. 6 highlights portions of the mini-control panel pressure circuit that are pressurized with rig air pressure. For simplicity, the pressure circuit shown in FIG. 6 will be referred to as the rig air pressure circuit. The rig air pressure typically ranges from 110 to 120 psi.

The rig air pressure circuit is plumbed to differential pressure valve 410. Under normal conditions, differential pressure valve 410 isolates rig air pressure from the rig air circuit downstream of the differential pressure valve 410. The isolated portion of the rig air pressure circuit extends to the diverter control panel (See FIG. 2) and is indicated in FIG. 6 with shading. When the upper packer fails (pressure in line B is lower than pressure in line A), differential pressure valve 410 opens, and the isolated portions of the rig air pressure circuit are pressurized. Pressure in the isolated portions of the circuit opens the secondary pressure source, which in turn, energizes the lower packer. The pressure that opens the secondary pressure source is referred to as the pilot pressure.

The embodiment of FIG. 6 includes horn 440 and mechanical indicator tab (flip tab) 450. Rig air pressure is provided to horn switch valve 460. Horn switch valve 460 is normally closed, preventing rig air pressure from reaching horn 440. When differential pressure valve 410 opens, pressure in the isolated portion of the circuit opens horn switch valve 460. Once horn switch valve 460 is open, rig air flows through horn 440 and sounds an audible alarm. The isolated part of the rig air pressure circuit also includes flip tab 450. Flip tab 450 is a mechanical tab displaying one color (green) when isolated from rig air pressure and another color (red) when exposed to rig air pressure.

The rig air pressure circuit is also optionally connected to air receiver cylinder 470. Air receiver cylinder 470 provides an additional backup if rig air pressure is lost. During normal operation, rig air maintains pressure in the air receiver cylinder 470 through check valve 480. If rig air pressure is lost, check valve 450 prevents air pressure in air receiver cylinder 470 from discharging through the rig air pressure line. Rig air pressure is also connected to receiver cylinder valve 490. Receiver cylinder valve 490 is a normally open valve. Rig air pressure keeps the receiver cylinder valve 490 closed. If rig air pressure is lost, receiver cylinder valve 490 opens. Optimally, receiver cylinder valve 490 opens when rig air pressure falls below 95 psi. The threshold for actuating the lower packer due to a rig air pressure drop is adjustable.

FIG. 7 highlights portions of the mini-control panel pressure circuit pressurized by air receiver cylinder 470. For simplicity, the pressure circuit shown in FIG. 7 will be referred to as the air receiver cylinder pressure circuit. The air receiver cylinder pressure circuit is connected to rig air pressure through check valve 480, as noted above. If rig air pressure is lost (drops below a specified pressure), the rig air pressure and the slip joint air pressure will be lost, resulting in an upper packer failure. When rig air pressure is lost, receiver cylinder valve 490 opens and air from receiver cylinder 470 pressurizes the circuit down stream of the receiver cylinder valve 490, indicated with shading. As the air discharges, it opens shuttle valve 500. Shuttle valve 500 prevents the cylinder air from discharging through horn 440. Pressure in the circuit down stream of the receiver cylinder valve 490 causes flip tab 450 to indicate an upper packer failure. Pressure in the circuit also acts as the pilot pressure that opens the secondary pressure source to energize the lower packer.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A pressure circuit for recognizing an upper packer failure comprising, an upper packer;

a first pressure source;

a first pressure circuit connected to said first pressure source and said upper packer;

a differential pressure valve configured to receive pressure from two points along said first pressure circuit, wherein the first point is closer to said first pressure source than the second point, and wherein said differential pressure valve opens when the pressure from said second point is an operational amount below the pressure from said first point;

a second pressure source; and a second pressure circuit connected to said second pressure source and said differential pressure valve, wherein a portion of said second pressure circuit is isolated from said second pressure source downstream of said differential pressure valve when said differential pressure valve is closed.

2. The pressure circuit of claim 1 wherein the pressure at said second point is an operational amount below the pressure at said first point when it is at least 0.5 psi lower than the pressure at said first point.

3. The pressure circuit of claim 1, further comprising a lower packer, wherein pressure from said second pressure source causes said lower packer to be energized when said differential pressure valve opens.

4. The pressure circuit of claim 3, wherein said first pressure source is the slip joint air pressure and said second pressure source is the rig air pressure.

5. The pressure circuit of claim 3, further comprising a hydraulic pressure source operably engaged to said lower packer, wherein said hydraulic pressure source energizes said lower packer responsive to said second pressure source.

6. The pressure circuit of claim 5, wherein said hydraulic pressure source is the diverter panel.

7. The pressure circuit of claim 1, further comprising, a third pressure source, a third pressure circuit connected to said third pressure source;

a normally open shuttle valve connected to said third pressure circuit and said second pressure circuit, wherein said normally open shuttle valve isolates said third pressure from portions of said third pressure circuit downstream of said normally open shuttle valve while said second pressure source is at or above an operational rig pressure.

8. The pressure circuit of claim 7, wherein said third pressure source is an air receiver cylinder.

9. The pressure circuit of claim 8, wherein said air receiver cylinder is charged by said second pressure source.

10. A riser slip joint circuit comprising, an upper packer;

a lower packer;

a first conduit containing a first pressure;

a second conduit containing a second pressure, wherein said second conduit is connected to said first conduit and said upper packer;

a third conduit containing a third pressure; and a differential pressure valve connected to said first, second, and third conduits, wherein said differential pressure valve allows the third pressure to energize the lower packer when the second pressure is operationally lower than the first pressure wherein said second conduit comprises a readback line.

11. The riser slip joint circuit of claim 10 further comprising a flow control valve positioned between said first conduit and said second conduit.

12. The riser slip joint circuit of claim 10, further comprising, a fourth conduit containing a fourth pressure; and a normally open valve connected to said third and fourth conduit, wherein said normally open valve allows the fourth pressure to energize the lower packer when the third pressure drops below an operational limit.

13. The riser slip joint circuit of claim 12, further comprising a receiver cylinder connected to said fourth conduit and wherein said fourth pressure is provided by said receiver cylinder.

14. The riser slip joint circuit of claim 13, further comprising a one-way valve between said third conduit and said forth conduit such that said fourth pressure is equal to or greater than said third pressure.

15. The riser slip joint circuit of claim 10, further comprising, a hydraulic pressure source connected to said lower packer, wherein said third pressure opens said hydraulic source when said second pressure is operationally lower than said first pressure.

16. The riser slip joint circuit of claim 15, wherein said hydraulic source is diverter control panel.

17. The riser slip joint circuit of claim 15, further comprising, a fourth conduit containing a fourth pressure; and a normally open valve connected to said third and fourth conduit, wherein said normally open valve allows the fourth pressure provides a signal to said hydraulic source when said third pressure drops below an operational limit.

18. The riser slip joint circuit of claim 10, wherein said first and second conduits are connected to the same pressure source and said second conduit is further from the pressure source than said first conduit.

19. The riser slip joint circuit of claim 10, wherein said first conduit, second conduit, third conduit, and differential pressure valve are located within a mini-control panel.

20. A method of controlling a riser slip joint comprising, transmitting slip joint pressure along a path between a pressure source and an upper packer; and comparing pressure at two points along the path using a differential pressure valve, wherein the distance between the two points is sufficient to cause the pressure at the point closest to the upper packer to be lower than the pressure at the point closest to the pressure source when there is a significant upper packer leak providing a pilot pressure to a hydraulic valve when the pressure at the point closest to the upper packer is an operationally lower than the pressure at the point closest to the pressure source.

21. The method of claim 20, further comprising, pressurizing the lower packer with hydraulic pressure when a pilot pressure is supplied to the hydraulic valve.

22. The method of claim 20, wherein the pilot pressure is provided by the rig air supply.

23. The method of claim 20, further comprising, providing a pilot pressure from a pressure reservoir to a hydraulic valve when the pressure provided by the pressure source drops below an operational limit.

24. The method of claim 20, further comprising, providing a pilot pressure from a pressure reservoir through a normally open valve to a hydraulic valve when rig pressure is insufficient to maintain the normally open valve in a closed position.

25. The method of claim 20, further comprising, restricting air from flowing between the first point and the second point with a flow control valve.

26. The method of claim 20, further comprising, flipping a mechanical indicator switch with the pilot pressure when the lower packer has been energized.

* * * * *